US006971174B2

(12) United States Patent
Liu et al.

(10) Patent No.: US 6,971,174 B2
(45) Date of Patent: Dec. 6, 2005

(54) METHOD OF MANUFACTURING A CASTER ROLL

(75) Inventors: Joshua C. Liu, Murrysville, PA (US); Teddy R. Creech, Badin, NC (US)

(73) Assignee: Alcoa Inc., Pittsburgh, PA (US)

( * ) Notice: Subject to any disclaimer, the term of this patent is extended or adjusted under 35 U.S.C. 154(b) by 55 days.

(21) Appl. No.: 10/705,299

(22) Filed: Nov. 10, 2003

(65) Prior Publication Data

US 2004/0128833 A1 Jul. 8, 2004

Related U.S. Application Data

(60) Provisional application No. 60/438,721, filed on Jan. 8, 2003.

(51) Int. Cl.[7] ..... B21D 53/00

(52) U.S. Cl. ..... 29/895.21; 492/46; 29/895; 29/895.3

(58) Field of Search ..... 29/895, 895.21, 29/895.3, 895.32; 492/46, 48

(56) References Cited

U.S. PATENT DOCUMENTS

| | | | | |
|---|---|---|---|---|
| 2,664,607 A | | 1/1954 | Hunter | |
| 2,790,216 A | | 4/1957 | Hunter. | |
| 2,850,776 A | | 9/1958 | Hunter | |
| 3,965,974 A | | 6/1976 | Sernetz et al. | |
| 4,086,957 A | | 5/1978 | Schrewe et al. | |
| 4,093,023 A | | 6/1978 | Frantsenjuk et al. | |
| 4,233,011 A | | 11/1980 | Bolender et al. | |
| 4,235,002 A | | 11/1980 | Pav et al. | |
| 4,256,034 A | | 3/1981 | Küsters et al. | |
| 4,285,107 A | | 8/1981 | Küsters et al. | |
| 4,519,118 A | | 5/1985 | Shinopulos et al. | |
| 4,576,845 A | | 3/1986 | Krotchko | |
| 4,593,744 A | | 6/1986 | Lewin et al. | |
| 4,631,792 A | | 12/1986 | Wesemann et al. | |
| 4,773,468 A | | 9/1988 | Lauener | |
| 4,844,747 A | * | 7/1989 | Jachowski et al. | 148/522 |
| 4,944,342 A | * | 7/1990 | Lauener | 165/485 |
| 4,955,433 A | | 9/1990 | Zaoralek | |
| 4,991,276 A | | 2/1991 | Bricmont | |
| 5,072,497 A | * | 12/1991 | Zaoralek et al. | 492/46 |
| 5,127,142 A | | 7/1992 | Howard | |
| 5,209,283 A | | 5/1993 | Miltzow et al. | |
| 5,215,765 A | | 6/1993 | Bergendahl | |
| 5,240,666 A | | 8/1993 | Schnyder et al. | |
| 5,263,920 A | | 11/1993 | Budza et al. | |
| 5,265,332 A | | 11/1993 | Hartz | |
| 5,279,535 A | | 1/1994 | Hawes et al. | |
| 5,292,298 A | * | 3/1994 | Scannell | 492/46 |
| 5,313,813 A | | 5/1994 | Heitze et al. | |
| 5,370,177 A | * | 12/1994 | Fey et al. | 165/89 |

(Continued)

*Primary Examiner*—David P. Bryant
*Assistant Examiner*—Stephen Kenny
(74) *Attorney, Agent, or Firm*—Robert A. Diaz; Eckert Seamans Cherin & Mellott, LLC

(57) ABSTRACT

The caster roll (10) is used in the manufacture of metal plate, strip, sheet, or foil. The caster roll (10) includes a cylindrical roll core (12) and at least one metal overlay (14) formed on the roll core (12). The at least one metal overlay (14) defines a plurality of cooling passages (34) for conducting a cooling medium through the at least one metal overlay (14) to cool the roll (10) during use. Additional metal overlays (16) may be formed on top of the at least one metal overlay. (14). The cooling passages (34) may also be formed in the roll core (12).

30 Claims, 9 Drawing Sheets

U.S. PATENT DOCUMENTS 5,598,633 A * 2/1997 Hartz ..... 29/895.212
5,651,410 A 7/1997 Perry et al.
5,655,596 A * 8/1997 Zaoralek ..... 165/90
5,839,501 A * 11/1998 Delassus et al. ..... 164/428
5,887,644 A 3/1999 Akiyoshi et al.
5,902,685 A * 5/1999 Schroder et al. ..... 428/615
5,983,993 A 11/1999 Watson et al.
6,095,237 A 8/2000 Haag
6,129,652 A 10/2000 Wenzel et al.
6,158,501 A 12/2000 Koivukunnas
6,220,161 B1 4/2001 De Vroome
6,257,321 B1 7/2001 Watson et al.

* cited by examiner

METHOD OF MANUFACTURING A CASTER ROLL

RELATED APPLICATION

This application claims the benefit of U.S. Provisional Patent Application Ser. No. 60/438,721, filed Jan. 8, 2003, entitled "Caster Roll and Method of Manufacture".

BACKGROUND OF THE INVENTION

1. Technical Field of the Invention

The present invention relates to caster rolls used in the manufacturing of sheet material and methods of manufacturing caster rolls. More particularly, the present invention relates to an internally cooled caster roll having one or more layers of material, such as metal, formed on a roll core of the castor roll and methods of manufacturing the caster roll.

2. Description of Related Art

In the manufacture of cast aluminum-plate, strip, sheet, or foil (hereinafter referred to as "aluminum sheet material"), conventional roll casting machines used to manufacture such aluminum sheet material typically have a twin-roll arrangement. In the twin-roll arrangement, a pair of substantially parallel, water-cooled, and counter-rotating rolls is used to cast the aluminum sheet material. Generally, after a given period of use, the surface, or roll shell, of these "caster" rolls must be reground and/or repaired because of heat cracks resulting from thermal fatigue and/or out-of-roundness (i.e., eccentricity) due to slipping between the roll core and roll shell. As the roll shell becomes thinner from regrinding, the roll shell surrounding the roll core must be replaced periodically and the roll core repaired before the twin-roll assembly is rebuilt.

It is generally known that the major cause of damage to prior art caster rolls is slipping between the roll core and the roll shell. The roll core in prior art caster rolls typically has circumferential grooves or channels formed in the surface of the roll core. The slipping typically occurs between the grooved or channeled surface of the roll core and the roll shell, which results in the formation of roll gaps between the roll core and roll shell. This leads to the aforementioned out-of-roundness (i.e., eccentricity) problem, which may ultimately result in misshaping the cast aluminum sheet material. Another problem associated with current caster rolls includes cracking in the roll shell due to thermal gradient and accompanying leakage of coolant onto the roll shell, which is a safety concern. Additionally, the thermal gradient along the surface of the roll core and roll core/roll shell slippage often cause the caster roll to distort or bend, which also may result in misshaping the cast aluminum sheet material during production runs.

One approach known in the art for extending the service life of caster rolls is disclosed in U.S. Pat. No. 5,598,633 to Hartz. In the Hartz '633 patent, the surface of the roll core is covered with two overlays of stainless steel each having a distinct hardness. The overlay of stainless steel directly in contact with the surface of the roll core is softer than the second, external overlay of stainless steel. An analogous approach to the foregoing is disclosed in U.S. Pat. No. 5,265,332 also to Hartz. The Hartz '332 patent attempts to extend the service life of the roll core by coating the inner surface of the roll shell with hard chromium.

Internally cooled rolls are well known in the field of continuous sheet casting machines. For example, U.S. Pat. No. 5,279,535 to Hawes et al. discloses an internally cooled caster roll for use in continuous sheet casting applications that includes a plurality of longitudinally extending coolant-conveying bores that extend the length of the caster roll. An annular manifold in the form of an end cap is secured within a recess formed in each end face of the caster roll and defines a plurality of discreet pathways, which places the open ends of the longitudinally extending bores in fluid communication with one another. The end caps additionally define a pathway formed to place the open end of one bore in fluid communication with a coolant inlet or coolant outlet passageway of the caster roll. A similar cooling roll having longitudinally extending cooling channels is disclosed in published International Application No. PCT/EP01/09818 (WO 02/26425).

U.S. Pat. No. 5,209,283 to Miltzow et al. discloses a caster roll comprising a roll core with a plurality of threads and a threaded sleeve, which threads onto the threaded roll core. The threaded connection between the roll core and roll sleeve defines a spiral channel through which a cooling medium flows to cool the caster roll. A similar "threaded" roll core is disclosed in U.S. Pat. No. 5,292,298 to Scannell.

U.S. Pat. No. 4,944,342 to Lauener discloses a continuous caster roll for casting aluminum sheet material. The caster roll is comprised of a roll shell enclosing a roll core. Cooling medium flows through axial cooling channels defined in the outer surface of the roll core. A counter flow principle is applied in the caster roll in which the cooling medium alternately flows in the cooling channels from one end of the caster roll to the other.

Further, U.S. Pat. No. 4,773,468 also to Lauener, discloses a method for extending the service life of a caster roll. In the caster roll disclosed by the Launer '468 patent, a plurality of rods is placed axially in grooves formed in the roll core of the caster roll. The rods protrude radially outward from the roll core and a roll shell is shrink-fitted onto the rods. As the roll is used in production runs, the roll shell wears and once the wear has proceeded to a predefined lower limit, the rods are replaced and a new roll shell is shrink-fitted onto the rods. Other references in the field of internally cooled caster rolls include U.S. Pat. No. 5,887,644 to Akiyoshi et al.; U.S. Pat. Nos. 2,850,776; 2,790,216; and 2,664,607 all to Hunter. The disclosure of each of the references identified hereinabove is incorporated into this disclosure by reference.

The foregoing references disclose various prior art arrangements and methods for manufacturing, internally cooling, and generally extending the service of caster rolls. Nonetheless, a need still exists for a reduced cost, internally cooled caster roll having an extended service life between roll shell replacements. Additionally, a need exists for a roll shell replacement method that reduces the costs associated with roll shell replacements generally, which is the primary capital outlay required to extend the service life of caster rolls.

SUMMARY OF THE INVENTION

The present invention is a caster roll used in the manufacturing of metal plate, strip, sheet, or foil. In one embodiment, the caster roll comprises a cylindrical roll core and at least one metal overlay formed on the roll core. The roll core has a central longitudinal axis and defines a plurality of longitudinally extending cooling passages for conducting a cooling medium through the roll core to cool the roll during use. The cooling passages may be located proximate to the surface of the roll core and may be spaced regularly about the central longitudinal axis of the roll core. The roll core may comprise a cylindrical roll body and two outward extending axles. The at least one metal overlay may be formed on the roll body. The cooling passages may extend substantially the entire length of the roll body, and may be spaced regularly about the central axis of the roll body.

The roll core may comprise at least one centrally located inlet passage and a plurality of radially extending passages extending from the at least one inlet passage to the cooling passages for conducting the cooling medium from the at least one inlet passage to the cooling passages. The at least one inlet passage may extend substantially parallel to the central longitudinal axis of the roll core and the radial passages may extend substantially perpendicular to the at least one inlet passage. Alternatively, the radial passages may each define an acute angle with the central longitudinal axis.

The roll core may further comprise at least one centrally located inlet passage and one centrally located outlet passage and a first and second plurality of radially extending passages. The first plurality of radially extending passages may extend from the at least one inlet passage to the cooling passages for conducting the cooling medium to the cooling passages and the second plurality of radially extending passages may extend from the cooling passages to the at least one outlet passage for conducting the cooling medium from the cooling passages to the at least one outlet passage. The at least one inlet passage and at least one outlet passage may extend substantially parallel to the central longitudinal axis of the roll core and the first and second plurality of radial passages may extend substantially perpendicular to the at least one inlet passage and at least one outlet passage. Alternatively, the first and second plurality of radial passages may each define an acute angle with the central longitudinal axis.

The at least one inlet passage and at least one outlet passage may extend from one of the axles of the roll core, through the roll body, and at least partially through the second axle. The cooling passages may extend the entire length of the roll body and end caps may be attached, respectively, to opposite ends of the roll body for closing the ends of the cooling passages.

In another embodiment, the roll generally comprises a cylindrical roll core having a central longitudinal axis and a metal overlay formed on the roll core. The metal overlay defines a plurality of cooling passages for conducting a cooling medium through the metal overlay to cool the roll during use. The cooling passages may extend substantially parallel to the central longitudinal axis of the roll core and longitudinally in the metal overlay, preferably substantially the entire length of the metal overlay. The cooling passages may be spaced regularly about the central longitudinal axis of the roll core.

The roll core may comprise a cylindrical roll body and two outward extending axles and the metal overlay may be formed on the roll body. The cooling passages may extend substantially the entire length of the roll body in the metal overlay. End caps may be attached, respectively, to opposite ends of the roll body for closing the ends of the cooling passages in the metal overlay.

In still another embodiment, the roll is generally comprised of a cylindrical roll core having a central longitudinal axis, a first metal overlay formed on the roll core, and at least one additional metal overlay formed on the first metal overlay. The first metal overlay preferably defines a plurality of cooling passages for conducting a cooling medium through the first metal overlay to cool the roll during use. Preferably, the first metal overlay has a hardness lower than the hardness of the at least one additional metal overlay. The cooling passages may extend substantially parallel to the central longitudinal axis of the roll core and substantially the entire length of the first metal overlay. The cooling passages may be spaced regularly about the central longitudinal axis of the roll core.

The roll may comprise a cylindrical roll body and two outward extending axles. The first metal overlay and the at least one additional metal overlay may be formed on the roll body. The cooling passages may extend substantially the entire length of the roll body and be spaced regularly about the central longitudinal axis of the roll core. End caps may be attached, respectively, to opposite ends of the roll body for closing the ends of the cooling passages in the first metal overlay.

The first metal overlay and the at least one additional metal overlay may each be formed to a thickness of less than about 6 inches and, preferably, between about 0.010 to 6 inches. The first metal overlay may be a thermally conductive metal, such as copper, bronze, steel, and the like. The at least one additional metal overlay may be a metal alloy, such as a nickel, cobalt, copper, or titanium based alloy. The at least one additional metal overlay may also be steel. The at least one additional metal overlay may be a single metal overlay formed on the first metal overlay and be comprised of any of the metals identified hereinabove.

The present invention is also a method of manufacturing a roll adapted for use in manufacturing metal plate, strip, sheet, or foil. The method may generally include the steps of: providing a cylindrical roll core having a central longitudinal axis; forming a plurality of longitudinally extending cooling passages in the roll core proximate to the surface of the roll core for conducting a cooling medium through the roll core to cool the roll during use; and forming at least one metal overlay on the roll core. The at least one metal overlay may be formed on the roll core by any one of the following processes or like processes: submerged arc welding, spray forming, thermal spraying, hot isostatic pressing, pack diffusion, vapor deposition, and electrolytic plating.

The cooling passages may be formed to be spaced regularly about the central longitudinal axis of the roll core. The step of forming the longitudinally extending cooling passages may comprise drilling holes in the roll core extending substantially parallel to the central longitudinal axis of the roll core. The roll core may have a roll body. The step of forming the longitudinally extending cooling passages may comprise drilling holes in the roll body extending substantially parallel to the central longitudinal axis of the roll core and the entire length of the roll body. The method may comprise the additional step of attaching end caps to opposite ends of the roll body to close the ends of the cooling passages. The method may further comprise the step of heat treating the roll to a temperature of between about 400° F. to 1500° F. for between about 1 to 48 hours after forming the at least one metal overlay on the roll core, particularly when the at least one metal overlay comprises steel.

The roll core may define at least one centrally located and longitudinally extending inlet passage. The method may further comprise the steps of: forming a plurality of radially extending passages in the roll core to connect the cooling passages to the at least one inlet passage; and plugging the radial passages at the surface of the roll core prior to the step of forming the at least one metal overlay on the roll core. The step of forming the radially extending cooling passages in the roll core may comprise drilling holes in the roll core extending substantially perpendicular to the central longitudinal axis of the roll core to connect the cooling passages to the at least one inlet passage. Alternatively, the step of forming the radially extending cooling passages in the roll core may comprise drilling holes in the roll core at an acute angle with respect to the central longitudinal axis of the roll core to connect the cooling passages to the at least one inlet passage.

The roll core may further define at least one centrally located and longitudinally extending outlet passage. The method may further comprise the steps of: forming a plurality of radially extending passages in the roll core to connect the cooling passages to the at least one inlet passage and the at least one outlet passage; and plugging the radial passages at the surface of the roll core prior to the step of forming the at least one metal overlay on the roll core. The radially extending cooling passages may be drilled in the roll core to extend substantially perpendicular to the central longitudinal axis of the roll core or at an acute angle with respect to the central longitudinal axis of the roll core to connect the cooling passages to the at least one inlet passage and at least one outlet passage.

In another embodiment, the method of manufacturing the roll generally comprises the steps of: providing a cylindrical roll core having a central longitudinal axis; forming a metal overlay on the roll core; and forming a plurality of longitudinally extending cooling passages in the metal overlay for conducting a cooling medium through the metal overlay to cool the roll during use. The metal overlay may be formed on the roll core by any of the processes indicated previously.

The cooling passages may be formed in the metal overlay to be spaced regularly about the central longitudinal axis of the roll core. The step of forming the longitudinally extending cooling passages may comprise drilling holes in the metal overlay extending substantially parallel to the central longitudinal axis of the roll core. The holes may be drilled in the metal overlay to extend substantially the entire length of the roll body. End caps may be attached to opposite ends of the roll body to close the ends of the cooling passages in the metal overlay. The roll may be heat treated to a temperature of between about 400° F. to 1500° F. for between about 1 to 48 hours after forming the metal overlay on the roll core, particularly when the metal overlay comprises steel.

The roll core may define at least one centrally located and longitudinally extending inlet passage. The method may further comprise the steps of: forming a plurality of radially extending passages in the metal overlay and roll core to connect the cooling passages to the at least one inlet passage; and plugging the radial passages at the surface of the metal overlay. The step of forming the radially extending cooling passages in the roll core may comprise drilling holes in the metal overlay and roll core extending substantially perpendicular to the central longitudinal axis of the roll core or at an acute angle with respect to the central longitudinal axis to connect the cooling passages to the at least one inlet passage.

The roll core may further define at least one centrally located and longitudinally extending outlet passage, and the method may further comprise the steps of: forming a plurality of radially extending passages in the metal overlay and roll core to connect the cooling passages to the at least one inlet passage and the at least one outlet passage; and plugging the radial passages at the surface of the metal overlay.

In another embodiment of the method of manufacturing the roll of the present invention, the method generally includes the steps of: providing a cylindrical roll core having a central longitudinal axis; forming a first metal overlay on the roll core; forming a plurality of longitudinally extending cooling passages in the first metal overlay for conducting a cooling medium through the first metal overlay to cool the roll during use; and forming at least one additional metal overlay on the first metal overlay. The first metal overlay and the at least one additional metal overlay may be formed on the roll core by any of the processes indicated previously. The cooling passages are preferably formed in the first metal overlay to be spaced regularly about the central longitudinal axis of the roll core. The step of forming the longitudinally extending cooling passages may comprise drilling holes in the first metal overlay extending substantially parallel to the central longitudinal axis of the roll core. End caps may be attached, respectively, to opposite ends of the roll body to close the ends of the cooling passages in the first metal overlay. The roll may be heat treated to a temperature of between about 400° F. to 1500° F. for between about 1 to 48 hours after forming the at least one additional metal overlay on the first metal overlay, particularly when the first metal overlay and/or the at least one additional metal overlay comprises steel.

The roll core may define at least one centrally located and longitudinally extending inlet passage and at least one centrally located and longitudinally extending outlet passages. The method may further comprise the steps of: forming a plurality of radially extending passages in the first metal overlay and roll core to connect the cooling passages to the at least one inlet passage; and plugging the radial passages at the surface of the first metal overlay prior to the step of forming the at least one additional metal overlay on the first metal overlay. The step of forming the radially extending cooling passages in the roll core may comprises drilling holes in the first metal overlay and roll core extending substantially perpendicular to the central longitudinal axis of the roll core or at an acute angle with respect to the central longitudinal axis of the roll core to connect the cooling passages to the at least one inlet passage.

The method also comprises the steps of: forming a plurality of radially extending outlet passages in the first metal overlay and roll core to connect the cooling passages to the at least one inlet passage and the at least one outlet passage; and plugging the radial passages at the surface of the first metal overlay prior to the step of forming the at least one additional metal overlay on the first metal overlay. The step of forming the radially extending cooling passages in the roll core may comprise drilling holes in the first metal overlay and roll core extending substantially perpendicular to the central longitudinal axis of the roll core or at an acute angle with respect to the central longitudinal axis of the roll core to connect the cooling passages to the at least one inlet passage and at least one outlet passage.

Additionally, the method of the present invention relates to resurfacing existing rolls, which may be adapted for use in manufacturing metal plate, strip, sheet, or foil. The resurfacing method generally comprises the steps of: providing an existing roll having a central longitudinal axis and a roll core comprising a work surface defining grooves. or channels; removing the existing work surface from the roll core to form a substantially smooth surface; forming a first metal overlay on the substantially smooth surface of the roll core; forming a plurality of longitudinally extending cooling passages in the first metal overlay; and forming at least one additional metal overlay on the first metal overlay.

The resurfacing method may further comprise the step of connecting the cooling passages to existing cooling conduits in the roll core. The first metal overlay and the at least one additional metal overlay may be formed on the roll core by any of the processes indicated previously.

Further details and advantages of the present invention will become apparent from the following detailed description when read in conjunction with the drawings, wherein like parts are designated with like reference numerals throughout.

DETAILED DESCRIPTION OF THE PREFERRED EMBODIMENTS

Figure 1:
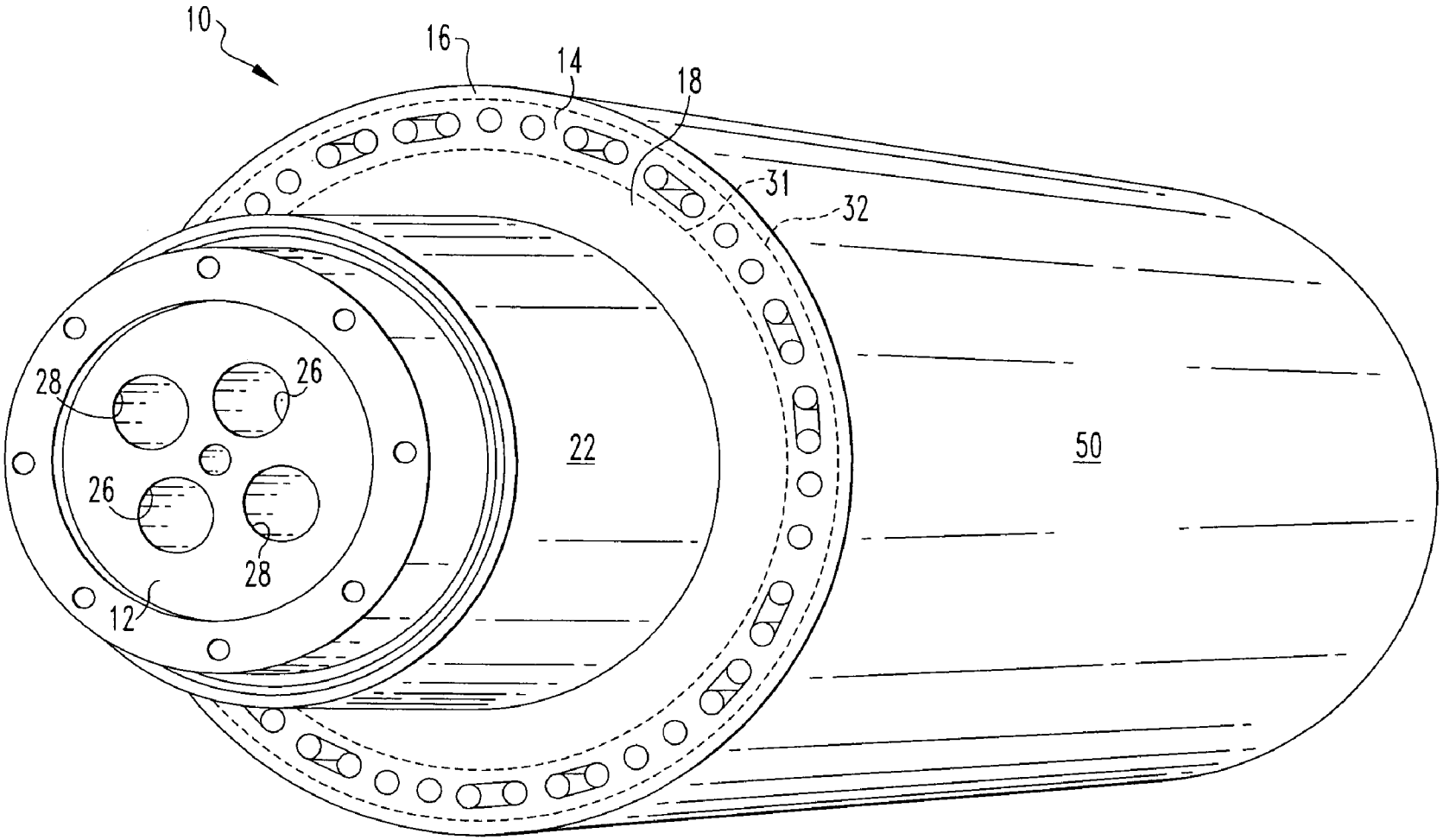
FIG. 1 is a perspective view of a caster roll in accordance with the present invention.

Referring to FIGS. 1–10, a caster roll 10 in accordance with the present invention is shown. The caster roll 10 is generally comprised of a roll core 12 and one or more metal overlays formed on the roll core 12. The roll core 12 is preferably solid as shown in the various accompanying figures, but may also be hollow (i.e., annular-shaped). In the embodiment of the caster roll 10 illustrated in FIGS. 1–10, two metal overlays are formed on the roll core 12. The two metal overlays are separately designated with reference numerals "14" and "16", respectively, throughout this disclosure. Accordingly, the caster roll 10 will be described hereinafter in terms of two metal overlays, including a first metal overlay 14 formed directly on the roll core 12 and a second metal overlay 16 formed on top of the first metal overlay 14. However, other embodiments described in this disclosure comprise only one metal overlay on the roll core 12. Additionally, the present invention is intended to encompass the use of three (3) or more metal overlays formed on the roll core 12.

The roll core 12 has a generally cylindrical construction and comprises a cylindrical center section or roll body 18 and two outward extending axles 20, 22. The first and second metal overlays 14, 16 are formed on top of the roll body 18, as discussed hereinafter. The roll body 18 forms the portion of the caster roll 10 that contacts or casts metal when the caster roll 10 is used in connection with continuous sheet casting machines (not shown). The caster roll 10 is intended for use with metal that may be in solid, semi-solid, or liquid form. One of the axles 20, 22 is preferably configured to be driven by the casting machine. Either axle 20, 22 may be configured as the "drive end" axle of the caster roll 10. For convenience in explaining the present invention, axle "20" will be referred to hereinafter as the "drive end axle 20" or "first axle 20". The other axle 22 is configured to admit a cooling medium into the roll core 12 and discharge the same in the manner discussed hereinafter and will be referred to as the "cooling end axle 22" or "second axle 22". A preferred cooling medium for the caster roll 10 is water. Cooling mediums other than water, such as oil or glycol, may be used in the caster roll 10, however water is preferred. The cooling medium may be a mixture of cooling mediums and chemical additives added to the cooling medium for preventing corrosion. The roll core 12 may be formed of 4340 Steel (i.e., low carbon steel) and substantially equivalent metals and materials. The cooling medium is referred to as cooling water hereinafter, but any of the cooling mediums (and mixtures) set forth hereinabove may be used in place of "cooling water" in the following discussion.

The roll core 12 defines one or more centrally located passages 24 that extend substantially through the roll core 12. The central passages 24 may also extend entirely through the roll core 12. In the caster roll 10 shown in FIGS. 1–10, the roll core 12 defines four (4) centrally located and longitudinally extending passages 24 for carrying water through the roll core 12. Additional or fewer central passages 24 may be used in the roll core 12 in accordance with the present invention, but the caster roll 10 will be described in this disclosure in terms of four (4) exemplary central passages 24. At a minimum, one (1) inlet or supply central passage 24 and one (1) outlet or return central passage 24, which are in fluid communication with each other, is all that is required for supplying cooling water to the roll core 12 and discharging the same in accordance with the present invention.

As indicated, the central passages 24 provide inlet (i.e., supply) and outlet (i.e., return) conduits for carrying water into and out of the roll core 12. In particular, the central passages 24 are generally divided into two cooling water inlet passages 26 and two cooling water outlet passages 28. The inlet and outlet passages 26, 28 are interconnected, respectively, and form two separate cooling water flow circuits in the roll core 12, which are identified herein with additional reference characters "a" and "b" for clarity. Accordingly, one of the inlet passages 26*a* is connected to one of the outlet passages 28*a* to form a first flow circuit, and the second inlet passage 26*b* is connected to the second outlet passage 28*b* to form a second flow circuit within the roll core 12. The cooling water "flow circuits" to be described hereinafter are an exemplary arrangement for cooling the roll core 12 and caster roll 10 of the present invention and may be replaced by any equivalent fluid flow arrangement, which is within the skill of one skilled in the art.

The openings to the inlet passages 26*a*, 26*b* and outlet passages 28*a*, 28*b* are located at the cooling end axle or second axle 22. The inlet passages 26*a*, 26*b* and outlet passages 28*a*, 28*b* preferably extend from the cooling end axle 22 through the roll body 18 and partially through the drive end axle 20. The inlet passages 26*a*, 26*b* and outlet passages 28*a*, 28*b* are preferably connected together, respectively, in both the drive end axle 20 and the cooling end axle 22. Alternatively, the inlet passages 26*a*, 26*b* and outlet passages 28*a*, 28*b* may be connected together, respectively, in either the drive end axle 20 or the cooling end axle 22. The inlet passages 26*a*, 26*b* carry cooling water from the cooling end axle 22 through the roll body 18 and into the drive end axle 20, and the outlet passages 28*a*, 28*b* then return the now heated water back to the cooling end axle 22, as described further herein.

The roll body 18 of the roll core 12 further defines a plurality of radially extending passages 30 that extend outward from the inlet passages 26*a*, 26*b* and outlet passages 28*a*, 28*b* to a surface 31 of the roll body 18. The radial passages 30 are generally in fluid communication with passages formed in the first metal overlay 14, as discussed herein. The inlet passages 26*a*, 26*b* are each preferably connected to four (4) radial passages 30, and the outlet passages 28*a*, 28*b* are each preferably connected to four (4) radial passages 30. However, additional or fewer radial passages 30 may be connected to the inlet passages 26*a*, 26*b* and outlet passages 28*a*, 28*b*. The choice of four (4) radial passages 30 connected to the inlet passages 26*a*, 26*b* and four (4) radial passages 30 connected to the outlet passages 28*a*, 28*b* is provided as an example to describe the caster roll 10. At a minimum, only one (1) radial passage 30 is required for each of the inlet passages 26*a*, 26*b* and outlet passages 28*a*, 28*b*. In the preferred embodiment, the radial passages 30 are formed into the roll body 18 after the first metal overlay 14 is applied to the roll body 18, as discussed hereinafter. Alternatively, the radial passages 30 may be formed in the roll body 18 prior to forming the first metal overlay 16.

The radial passages 30 are preferably symmetrically distributed around the circumference of the roll body 18 and in fluid communication with longitudinal passages that may be formed in the first metal overlay 14, as discussed further hereinafter. The radial passages 30 defined in the roll body 18 of the roll core 12 are provided to conduct cooling water to these "longitudinal passages" and then return heated water to the central passages 24. In general, cooling water is conducted through inlet passages 26*a*, 26*b*, outward in the roll body 18 through the radial passages 30. Heated water is returned through the radial passages 30 to the outlet passages 28*a*, 28*b*. The outlet passages 28*a*, 28*b* then conduct the heated water out of the roll core 12. The radial passages 30 are preferably provided at both ends of the roll body 18 (i.e., proximate to the ends of the roll body 18), but may also be located at only one end of the roll body 18.

The inlet passages 26*a*, 26*b* conduct cooling water into the roll core 12 and, for this purpose, are preferably in fluid communication with an external source of cooling water (not shown) such as an evaporative cooling system (i.e., cooling tower). The outlet passages 28*a*, 28*b* return heated water to the cooling water source, or other location. The radial passages 30 enable cooling water to be conducted from the inlet passages 26*a*, 26*b* to the first metal overlay 14 and returned to the outlet passages 28*a*, 28*b*.

Referring to FIGS. 1–13, the surface 31 of the roll body 18 is preferably free of grooves and channels, such as those that are generally found in prior art caster rolls. The first metal overlay 14 is formed on top of the relatively smooth surface 31 (i.e., free of grooves and channels) of the roll body 18. The second metal overlay 16 is formed on top of a surface 32 of the first metal overlay 14. Preferably, the first and second metal overlays 14, 16 are formed on the roll body 18 by a metal deposition process, such as: submerged arc welding, spray forming, thermal spraying, hot isostatic pressing, pack diffusion, vapor deposition, electrolytic plating and the like.

Figure 16:
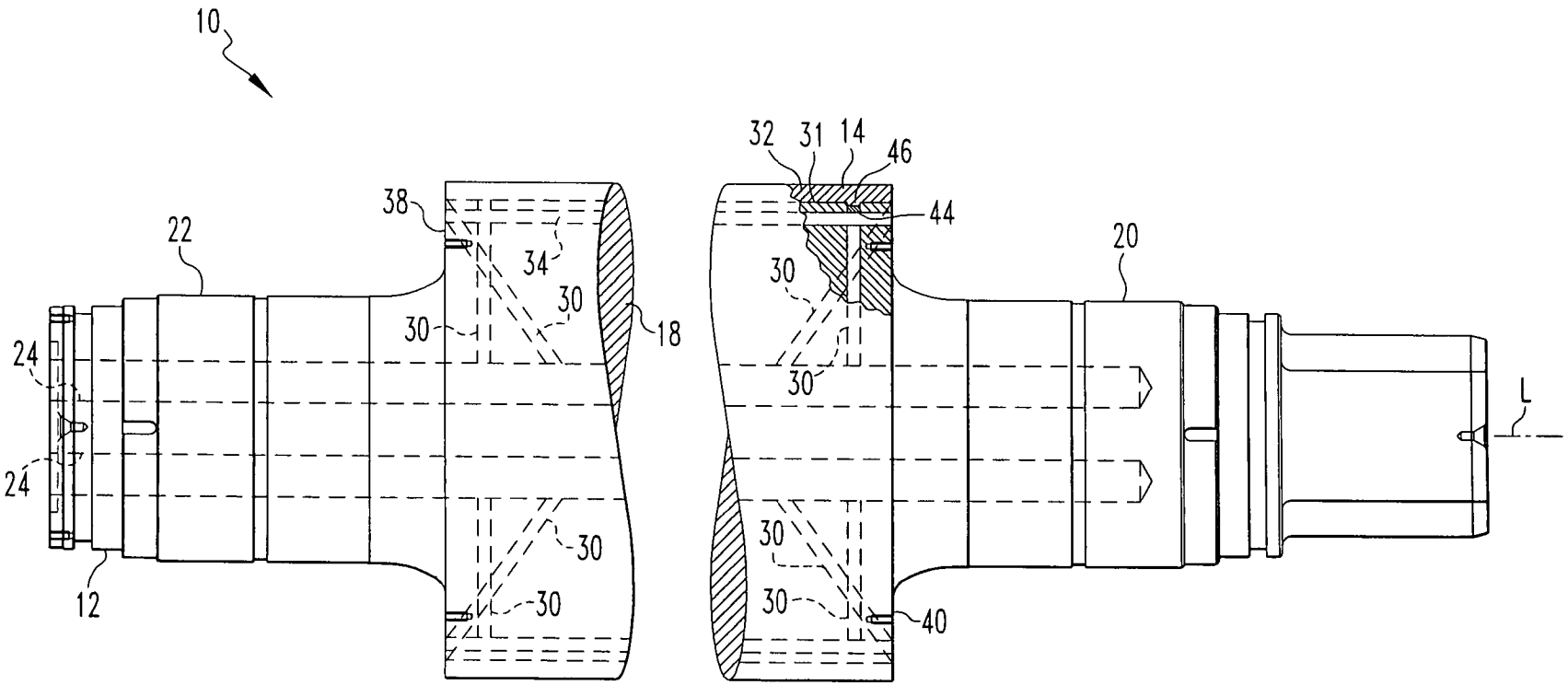
FIG. 16 is an elevational and partial cross sectional view of another embodiment of the caster roll of FIG. 1.

The caster roll 10 according the present invention is provided with a plurality of enclosed cooling medium conduits or passages 34 that extend longitudinally in the caster roll 10 for cooling the caster roll 10 during use. In the presently preferred embodiment of the caster roll 10, the cooling passages 34 are formed in the first metal overlay 14. In another embodiment of the caster roll 10, the cooling passages 34 are formed in the roll core 12. The cooling passages 34 are placed in fluid communication with the inlet passages 26*a*, 26*b* and outlet passages 28*a*, 28*b* preferably by forming (i.e., drilling) the radial passages 30 into the roll core 12 after the first metal overlay 14 is formed on the roll core 12 and the cooling passages 34 are formed (i.e., by drilling longitudinally) in the first metal overlay 14. The embodiment of the caster roll 10 wherein the cooling passages 34 are provided in the first metal overlay 14 will be discussed next in this disclosure. The embodiment of the caster roll 10 wherein the cooling passages 34 are provided in the roll core 12 is discussed in connection with FIG. 16 later in this disclosure. The caster roll 10 illustrated in FIG. 16 is formed in a similar manner to the caster roll 10 shown, for example, in FIG. 2, wherein the cooling passages 34 are first formed by drilling longitudinally extending holes or apertures in the roll body 18 and then drilling the radial passages 30 to connect the cooling passages 34 to the inlet passages 26*a*, 26*b* and outlet passages 28*a*, 28*b*.

The cooling passages 34 preferably extend substantially parallel to a central longitudinal axis L of the roll core 12 and radially outward from the central longitudinal axis L. The cooling passages 34 further preferably extend the entire length of the first metal overlay 14 and the roll body 18 and are spaced regularly about the circumference of the roll body 18. As indicated previously, the cooling passages 34 may be formed by drilling longitudinal holes the length of the first metal overlay 14. Additionally, as indicated previously, the radial conduits 30 may be formed by drilling radially into the first metal overlay 14 and roll core 12 to connect the cooling passages 34 to the central passages 24 (i.e., the inlet passages 26*a*, 26*b* and outlet passages 28*a*, 28*b*). In practice, the cooling passages 34 are only required to extend substantially the distance between the openings of the radial passages 30 to connect the cooling passages 34 to the inlet passages 26*a*, 26*b* and outlet passages 28*a*, 28*b*. Consequently, the cooling passages 34 are not necessarily limited to extending the entire length of the first metal overlay 14.

The first metal overlay 14 is preferably made of a metal or metal alloy exhibiting good thermal conductivity properties such as copper, bronze, steel, stainless steel, and the like. The second metal overlay 16 is preferably a metal that is resistant to thermal fatigue cracking wear. A suitable metal for the second metal overlay 16 will have a hardness range in the range of 30 to 66 Rockwell C, preferably 55 to 60 Rockwell C. An exemplary list of metals for the second metal overlay 16 includes: steel and nickel, cobalt, copper, and titanium based alloys.

The cooling passages 34 are preferably formed so that adjacent pairs of cooling passages 34 are interconnected at one of the ends of the roll body 18 of the roll core 12. Thus, the adjacent pairs of cooling passages 34 form cooling flow paths or conduits comprised of one "inlet" or "supply" cooling passage 34, which is connected to a radial passage 30 that is in turn connected to one of the inlet passages 26*a*, 26*b*, and one "outlet" or "return" cooling passage 34, which is connected to a radial passage 30 that is in turn connected to one of the outlet passages 28*a*, 28*b*. Accordingly, the cooling passages 34, radial passages 30, and inlet and outlet passages 26, 28 are all in fluid communication and define an internal cooling medium flow system within the caster roll 10 that distributes cooling water from an external source to the interior of the roll core 12 and roll body 18 through the inlet passages 26*a*, 26*b*, then outward in the roll body 18 through the radial passages 30, and finally to the interior of the first metal overlay 14 through the cooling passages 34. An analogous return path to the external source of cooling water is also provided by the above-described flow system, as will be appreciated by one skilled in the art. The cooling passages 34 are not required to be interconnected, and may be provided as single cooling passages 34.

As indicated previously, an additional metal overlay such as the second metal overlay 16 and, possibly, multiple metal overlays or coatings may be formed on top of the first metal overlay 14. The second metal overlay 16 is formed on the surface 32 of the first metal overlay 14 preferably by any one of the metal deposition processes or techniques identified previously. For example, the second metal overlay 16 may be provided as a thin, hard coating of metal such as tungsten, carbide, or chromium, which is applied to the surface 32 of the first metal overlay 14 by a vapor deposition technique, an electrolytic plating technique (i.e., for chromium), or by one of the techniques identified previously.

Figure 14:
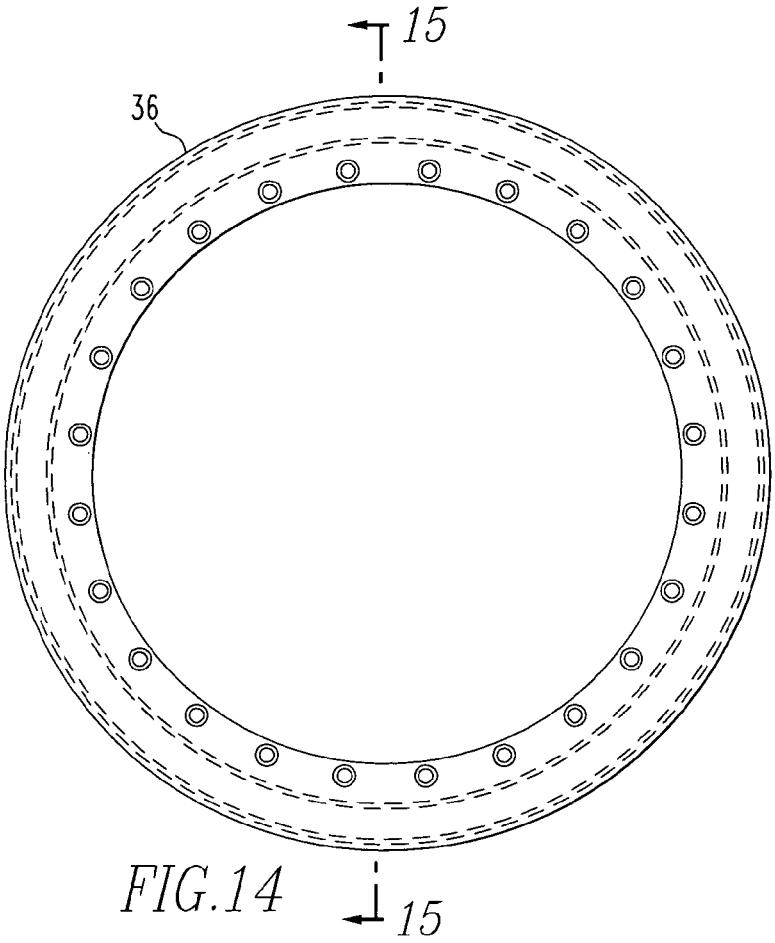
FIG. 14 is an end view of an end cap shown attached to the caster roll in FIG. 2.

End caps 36 (also shown in FIGS. 14 and 15) are provided at opposite ends 38, 40 (i.e., first and second ends 38, 40, respectively) of the roll body 18 of the roll core 12 to seal the open ends of the cooling passages 34 and to interconnect the "inlet" and "outlet" cooling passages 34 as necessary. The end caps 36 are annular shaped (as shown in FIG. 14) to fit over the respective axles 20, 22 and may be sealed to the first and second ends 38, 40 of the roll body 18 by conventional O-rings (not shown) and mechanical fasteners 42. The end caps 36 close the open ends of the cooling passages 34 to close the cooling medium flow system.

Figure 5:
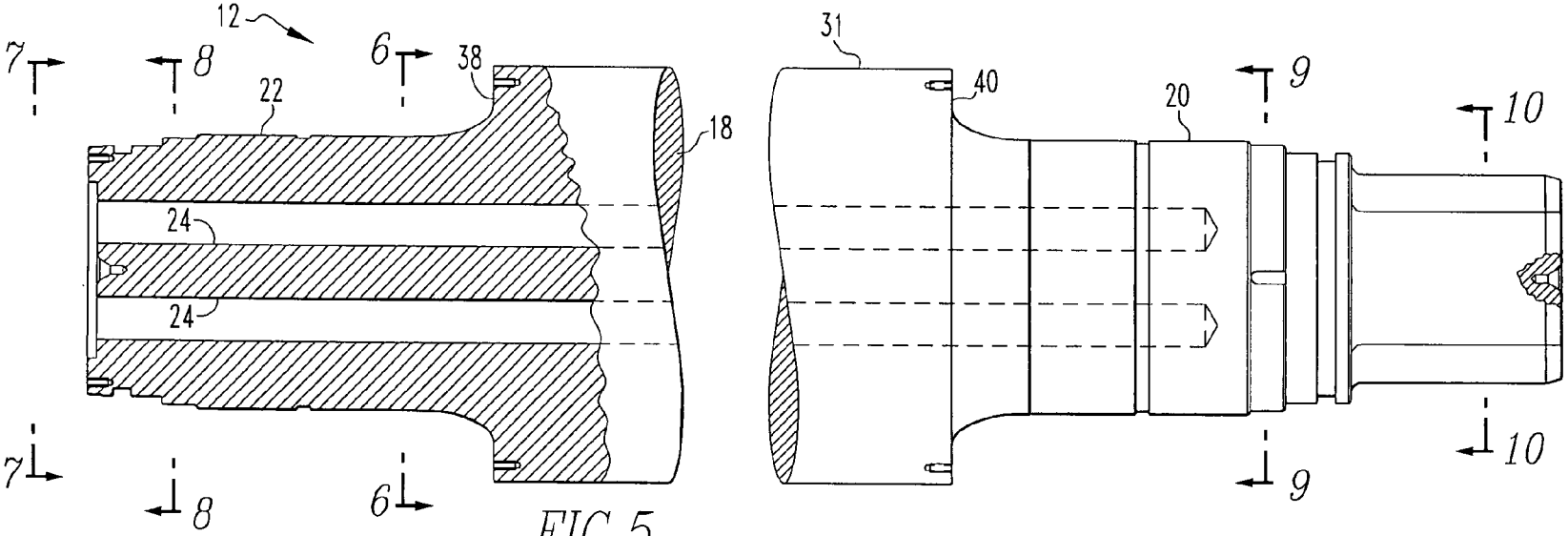
FIG. 5 is an elevational and partial cross sectional view of the caster roll of FIG. 1 shown without metal overlays on the roll core and further showing hidden lines.
Figure 6:
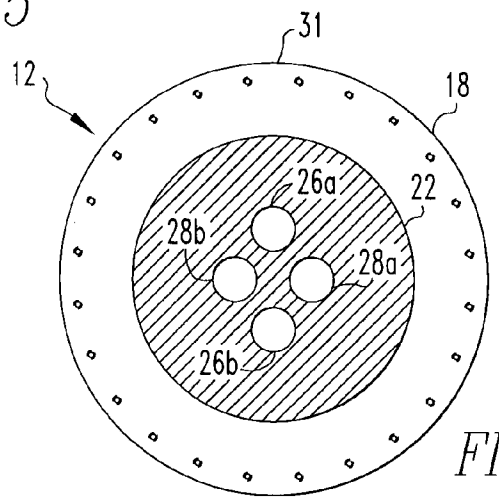
FIG. 6 is a cross sectional view of the caster roll taken along line 6—6 in FIG. 5.
Figure 7:
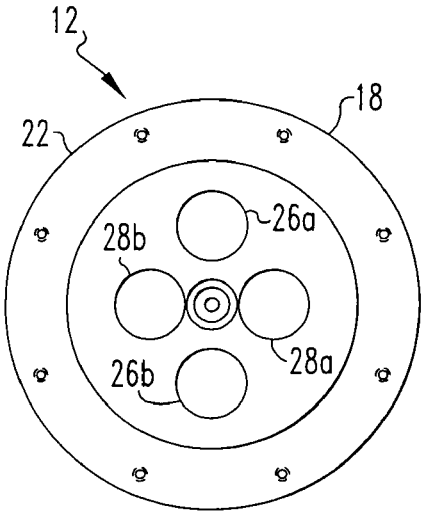
FIG. 7 is an end view of the caster roll of FIG. 5.
Figure 9:
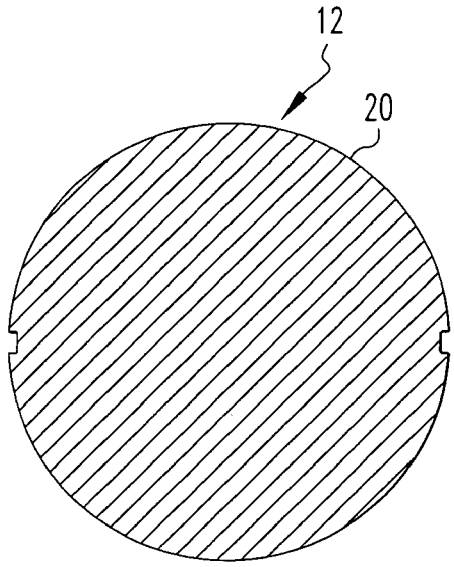
FIG. 9 is a cross sectional view of the caster roll taken along line 9—9 in FIG. 5.
Figure 8:
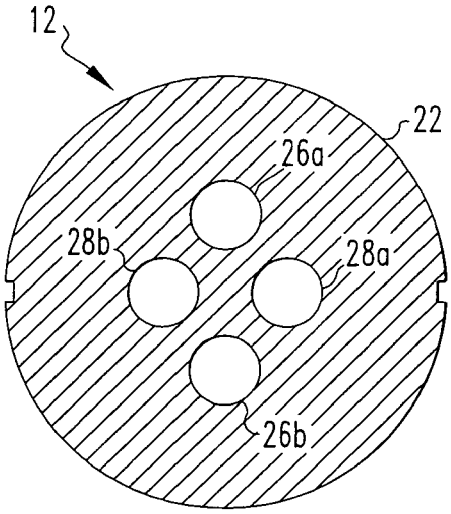
FIG. 8 is a cross sectional view of the caster roll taken along line 8—8 in FIG. 5.
Figure 10:
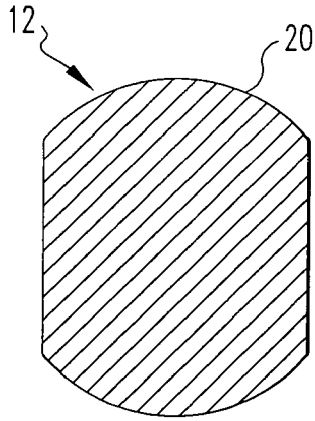
FIG. 10 is a cross sectional view of the caster roll taken along line 10—10 in FIG. 5.
Figure 11:
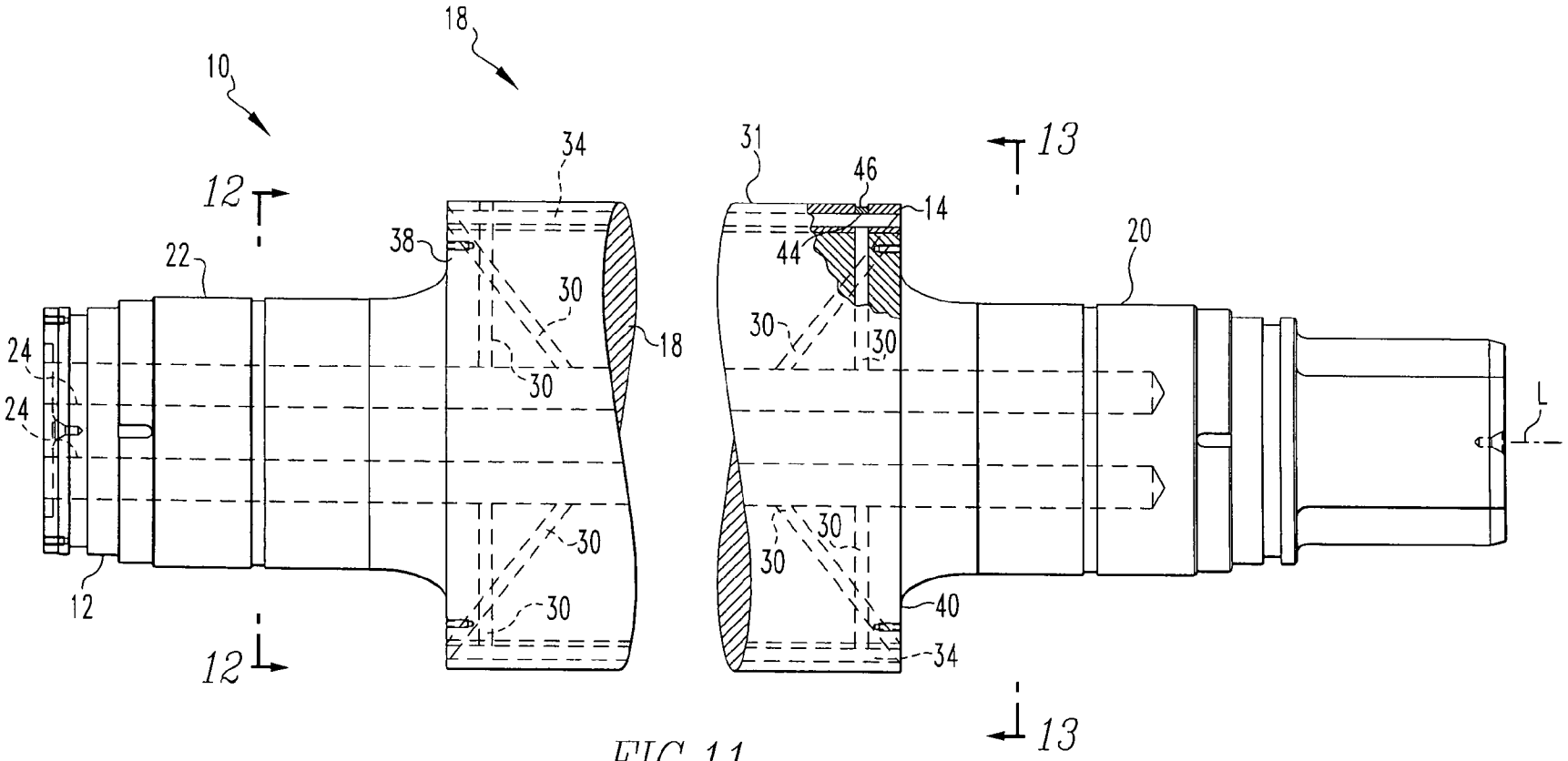
FIG. 11 is an elevational and partial cross sectional view of the caster roll of FIG. 1 shown with a first metal overlay on the roll core and further showing hidden lines.

With continued reference to FIGS. 1–13, a method of manufacturing the caster roll 10 wherein the cooling passages 34 are provided in the first metal overlay 14 will now be discussed. As indicated previously, the surface 31 of the roll body 18 is preferably provided free of external channels or grooves and preferably has a surface roughness suitable for depositing the first metal overlay 14 onto the surface 31 of the roll body 18 by any of the processes identified previously. FIG. 5 shows the roll core 12 and roll body 18 prior to forming (i.e., depositing) the first metal overlay 14 onto the surface 31 of the roll body 18. It should be noted that the radial passages 30 are not yet formed in the roll core 12. FIG. 11 shows the first metal overlay 14 after being deposited or applied onto the surface 31 of the roll body 18 and after the radial passages 30 are formed in the roll core 12 to connect the cooling passages 34 to the central passages (i.e., inlet passages 26*a*, 26*b* and outlet passages 28*a*, 28*b*).

Once the first metal overlay 14 is formed on the surface 31 of the roll body 18, the cooling passages 34 may be formed in the first metal overlay 14. This is accomplished by drilling longitudinally extending holes in the first metal overlay 14, which form the cooling passages 34. The cooling passages 34 are preferably formed at regular angular intervals around the roll body 18. The cooling passages 34 are spaced radially outward from the central passages 24 (i.e., inlet and outlet passages 26, 28) and the central longitudinal axis L.

Figure 2:
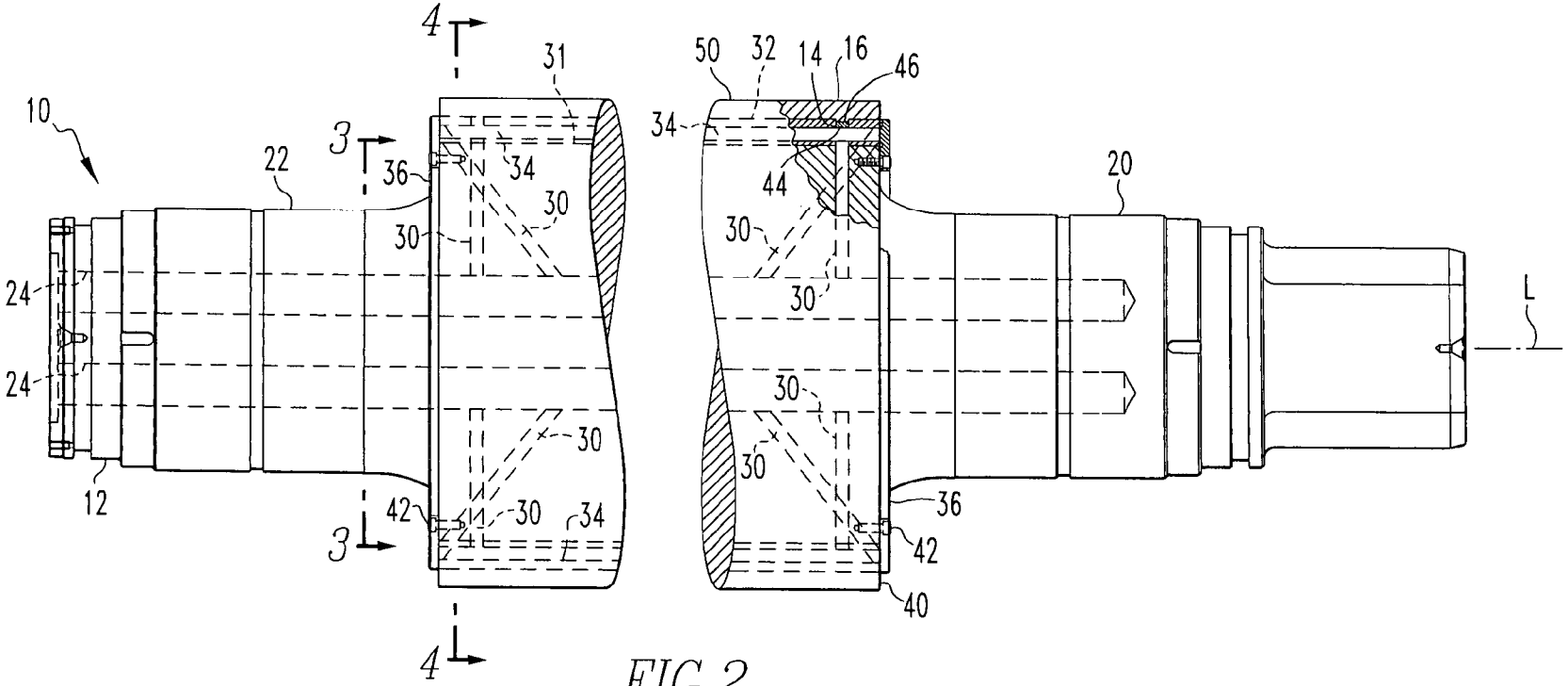
FIG. 2 is an elevational and partial cross sectional view of the caster roll of FIG. 1 showing hidden lines.
Figure 3:
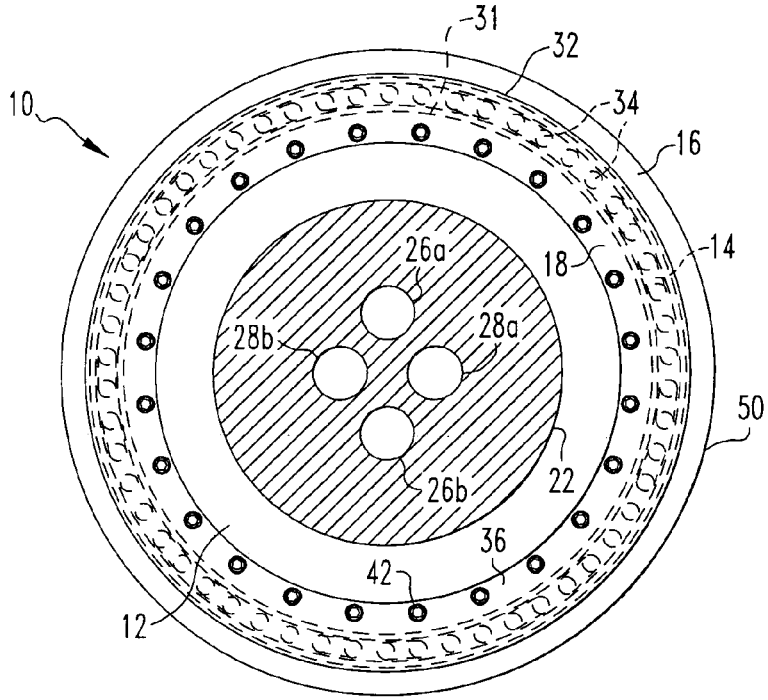
FIG. 3 is a cross sectional view of the caster roll taken along line 3—3 in FIG. 2.
Figure 4:
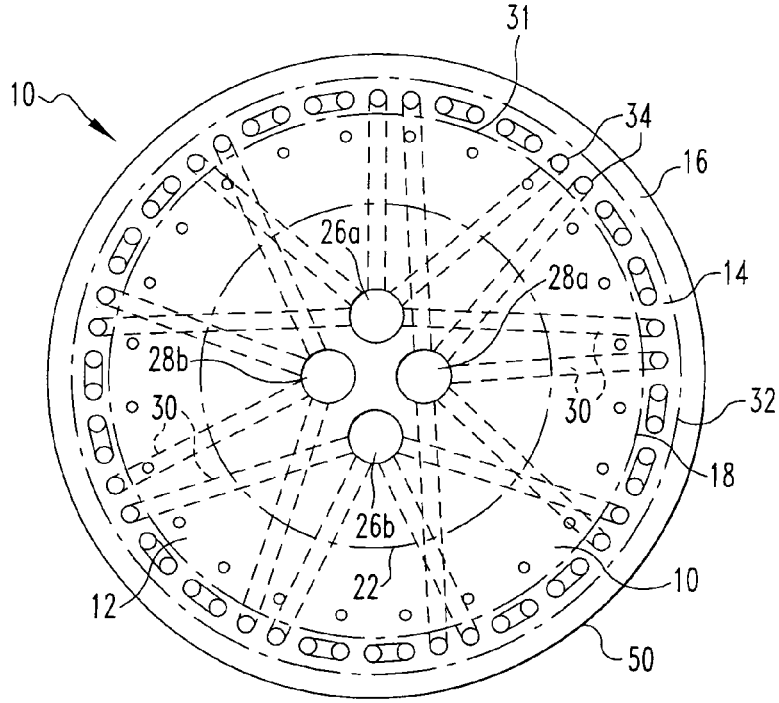
FIG. 4 is a cross sectional view of the caster roll taken along line 4—4 in FIG. 2, with cross hatching omitted for clarity.

Once the longitudinally extending cooling passages 34 are formed in the first metal overlay 14, the cooling passages 34 may be formed in the roll core 12 to place the cooling passages 34 in fluid communication with the central passages 24 (i.e., inlet and outlet passages 26, 28) in the roll core 12. The cooling passages 34 are formed by drilling radially into the first metal overlay 14 and roll core 12 at the desired pre-selected angular locations where the radial passages 30 are to be located in the roll core 12. The drilling process forms radial holes 44 in the first metal overlay 14 that must be plugged before the second metal overlay 16 is formed on the first metal overlay 14. The radial holes 44 are plugged by a plurality of plugs 46, as shown in FIGS. 2 and 11. The plugs 46 are preferably made of the same type of metal as the first metal overlay 14.

As discussed previously, any number of longitudinally extending cooling passages 34 may be provided in the first metal overlay 14, which may be placed in fluid communication with any number of radial passages 30 formed in the roll core 12. The cooling passages 34 are intended to conduct cooling water through the first metal overlay 14, preferably the length of the first metal overlay 14, and return heated water to the radial passages 30 in fluid communication with the outlet passages 28*a*, 28*b*.

Once the longitudinally extending cooling passages 34 and radial passages 30 are formed in the first metal overlay 14 and roll body 18 of the roll core 12, the second metal overlay 16 is preferably formed directly on top of the first metal overlay 14. The second metal overlay 16 may be applied by any of the metal deposition or forming processes indicated previously. The second metal overlay 16 is preferably made of any of the hard metals identified previously. The second metal overlay 16 will generally have a hardness higher than the hardness of the first metal overlay 14. Preferably, the first and second metal overlays 14, 16 each have a thickness of about 0.010 to 6 inches. The second metal overlay 16 generally forms the "work surface" of the caster roll 10.

The caster roll 10 may be subjected to further treatment steps once the second metal overlay 16 is formed on the first metal overlay 14. For example, the caster roll 10 may be heat treated to a temperature of between about 400° F. to about 1500° F. for a time period of about 1–48 hours to produce a hardness in the range of about 30 to 66 Rockwell C, as indicated previously, in the first and second metal overlays 14, 16, particularly when the first and second metal overlays 14, 16 comprise steel. Additionally, a surface 50 of the second metal overlay 16 (i.e., the preferred work surface of the caster roll 10) may be roughened such that the surface 50 of the second metal overlay 16 has a surface roughness suitable for manufacturing commercial aluminum plate, strip, sheet, or foil. The plugs 46 are preferably formed flush with the surface 32 of the first metal overlay 14, or recessed into the first metal overlay 14 before the second metal overlay 16 is formed on the first metal overlay 14. The deposition or formation of the second metal overlay 16 onto the first metal overlay 14 will fill any recesses defined in the first metal overlay 14 in the vicinity of the plugs 46.

In an alternative embodiment of the caster roll 10, the second metal overlay 16 may be omitted from the caster roll 10, such as illustrated in FIG. 11. The surface 32 of the first metal overlay 14 will now form the "work surface" of the caster roll 10. Accordingly, the first metal overlay 14 in this embodiment is preferably formed of a hard metal, such as the metals identified previously in connection with the second metal overlay 16. The metal plugs 46 are used to seal the radial holes 44 formed in the first metal overlay 14. The plugs 46 are preferably formed flush with the surface 32 of the first metal overlay 14. The true "work surface" area for this alternative embodiment of the caster roll 10 is generally the surface 32 of the first metal overlay 14 lying between the plugs 46. The previously discussed heat treatment and surface roughening steps may be also be applied to the caster roll 10 having only the first metal overlay 14 as the "work surface" of the caster roll 10.

Additionally, as shown in dotted lines in FIGS. 2 and 11, the radial passages 30 may be formed at an angle with respect to the central longitudinal axis L of the roll core 12 and the central passages 24 (i.e., inlet and outlet passages 26, 28). This eliminates the need for the plugs 46 because the radial passages 30 are formed in the ends 38, 40 of the roll body 18. The end caps 36 are used to seal the open ends of the cooling passages 34, as described previously, and may be further used to seal the open ends of the "angled" radial passages 30. The use of the "angled" radial passages 30 allows the entire surface 32 of the first metal overlay 14 to be used as the "work surface" of the caster roll 10, in the embodiment of the caster roll 10 wherein only the first metal overlay 14 is applied to the roll core 12. The "angled" radial passages 30 may also be applied to the presently preferred embodiment of the caster roll 10 having two or more metal overlays (i.e., the first and second metal overlays 14, 16). A suitable angle for the "angled" radial passages 30 is an acute angle, preferably an acute angle in the range of about 75° or less.

The methods described hereinabove for applying the first and second metal overlays 14, 16, as well as additional metal overlays (if any), to the roll body 12 may also be applied to existing caster rolls. Specifically, the first and second metal overlays 14, 16 may be applied to, for example, existing caster rolls having circumferential grooves or channels that define water passages for cooling the caster roll. A typical example of such a "grooved" or "channeled" caster roll is disclosed in U.S. Pat. No. 5,292,298 to Scannell, discussed previously.

The first and second metal overlays 14, 16 may be applied, for example, to the caster roll disclosed by the Scannell patent by removing the roll shell from the roll core and, further, the machined circumferential grooves or channels (i.e., spiral ribs) formed on the roll core. The resulting roll core preferably has a substantially smooth surface, which generally means that the roll core is free of the original machined grooves or channels (i.e., spiral ribs). The first metal overlay 14 may then be applied as described previously. The longitudinally extending cooling passages 34 may be formed in the first metal overlay 14 in the manner discussed previously. Thereafter, the cooling passages 34 may be placed in fluid communication with existing radial and axial bores, channels, or conduits defined in the roll core of the existing caster roll, such as the heat transfer roll disclosed by the Scannell patent. The plugs 46 may be used to seal the radial holes 44 formed in the first metal overlay 14. Finally, the second metal overlay 16 and possibly additional metal overlays may be formed on the first metal overlay 14 in the manner described previously. The process described previously for forming the caster roll 10 having only one metal overlay (i.e., the first metal overlay 14) may also be used to "resurface" the existing caster roll, such as the heat transfer roll disclosed by the Scannell patent. The disclosure of the Scannell patent is relied upon only to illustrate the application of the processes discussed previously for forming the caster roll 10 of the present invention to existing caster rolls. The foregoing "retro-fitting" or "resurfacing" process is believed to be applicable to any internally cooled caster roll used in the continuous sheet casting field and this disclosure should not be interpreted as being applicable only to the specific arrangement of the caster roll disclosed by the Scannell patent.

Referring to FIG. 16, another embodiment of the caster roll 10 in accordance with the present invention is shown. In FIG. 16, the cooling passages 34 are now formed within the roll body 18 instead of the first metal overlay 14. Accordingly, the entire fluid flow path for the cooling water is located within the roll core 12. The cooling passages 34 are in fluid communication with the radial passages 30 and the radial passages 30 are in fluid communication with the inlet and outlet passages 26, 28 as discussed previously. The radial passages 30 may be "angled" in the manner discussed previously in connection with FIGS. 2 and 11.

In general, the embodiment of the caster roll 10 shown in FIG. 16 is substantially similar to the embodiments of the caster roll 10 having discussed previously having one metal overlay (i.e., first metal overlay 14) and two or more metal overlays (i.e., first and second metal overlays 14, 16), except that the cooling passages 34 are now formed within the roll body 18 instead of in the first metal overlay 14. The cooling passages 34 and radial passages 30 are formed in the same manner as described previously, for example by drilling longitudinally into the roll body 18 to form the cooling passages 34 and radially into the roll body 18 to form the radial passages 30. The caster roll 10 shown in FIG. 16 may have one metal overlay (i.e., first metal overlay 14) or two or more metal overlays (i.e., first and second metal overlays 14, 16) formed on the roll body 18 in accordance with the present invention. However, as will be appreciated by one skilled in the art, the plugs 46 in the embodiment of the caster roll 10 illustrated in FIG. 16 will now be inserted into the radial passages 30 at the surface 31 of the roll body 18. The first metal overlay 14 may then be formed onto the surface 31 of the roll body 18 and cover the plugs 46. If desired, additional metal overlays, such as the second metal overlay 16 may then be applied to the first metal overlay 14. The end caps 36 may be used to seal the cooling passages 34 at the ends 38, 40 of the roll body 18. The end caps 36 may be further used to seal the "angled" radial passages 30 when these are used in the caster roll 10 illustrated in FIG. 16. Generally, only one metal overlay (i.e., first metal overlay 14) will be necessary in the caster roll 10 of FIG. 16, made of any of the materials identified previously in connection with the second metal overlay 16 (i.e., a hard metal).

The flow pattern of the cooling water within the caster roll 10 and associated method of cooling the caster roll 10 will generally be described hereinafter with reference to FIGS. 1–16 and specifically with reference to the caster roll 10 having the first and second metal overlays 14, 16. The cooling water first enters the caster roll 10 through the inlet passages 26*a*, 26*b*. The cooling water flows through the roll core 12 through the inlet passages 26*a*, 26*b*, which extend at least partially through the drive end axle 20. The cooling water then flows outward in the roll body 18 through the radial passages 30 in fluid communication with the inlet passages 26*a*, 26*b* (i.e., "supply" radial passages 30). The cooling water then flows longitudinally the length of the first metal overlay 14 (or roll body 18) through the "inlet" or "supply" cooling passages 34. Once reaching the end of the respective inlet cooling passages 34, the now heated water flows back the length of the first metal overlay 14 (or roll body 18) through the respectively interconnected "outlet" or "return" cooling passages 34, which are in fluid communication with the outlet passages 28*a*, 28*b* through the "return" radial passages 30. In summary, the heated water flows back the length of the first metal overlay 14 (or roll body 18) through the outlet cooling passages 34 and into the return radial passages 30. The return radial passages 30, as stated, are in fluid communication with the outlet passages 28*a*, 28*b* in the roll core 12. The outlet passages 28*a*, 28*b* conduct the heated water out of the roll core 12. The inlet passages 26*a*, 26*b* are preferably in fluid communication with a continuous source of cooling water to continuously provide cooling water to the caster roll 10 during its operation.

Figure 12:
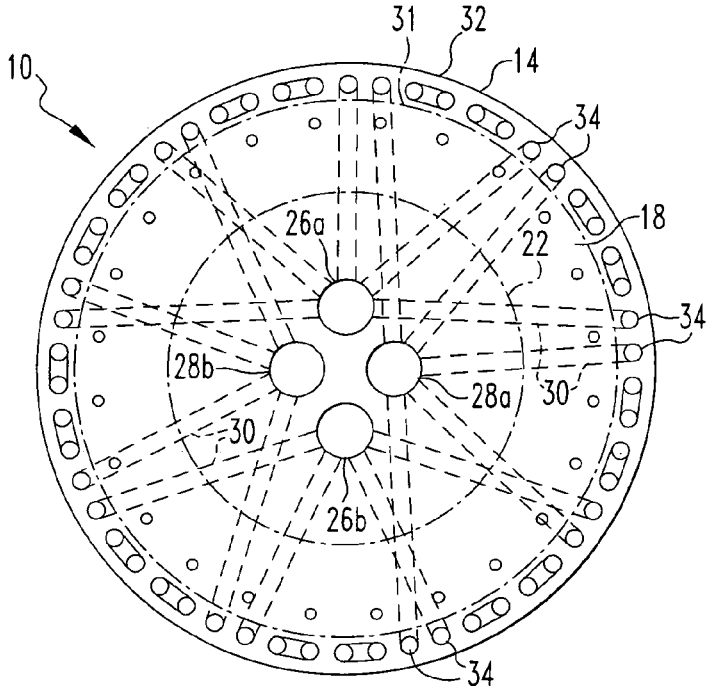
FIG. 12 is a cross sectional view of the caster roll taken along line 12—12 in FIG. 11, with cross hatching omitted for clarity.
Figure 13:
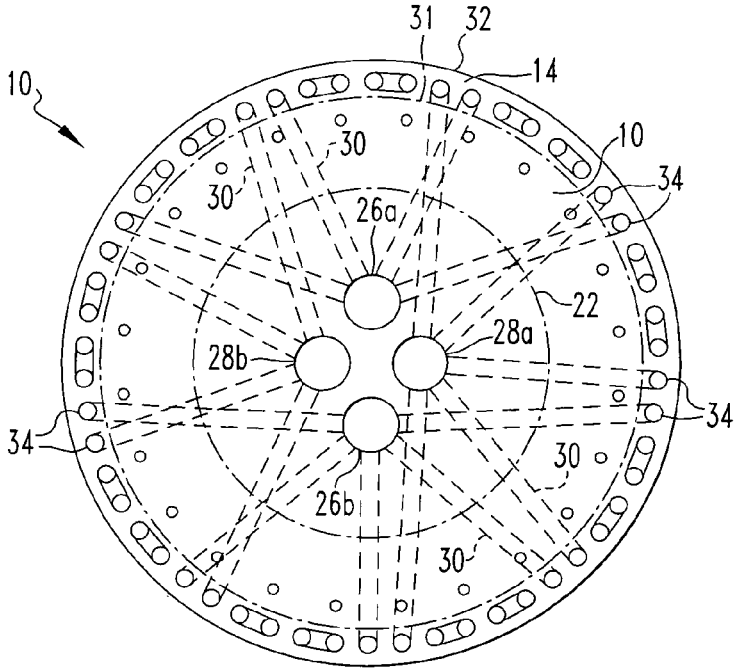
FIG. 13 is a cross sectional view of the caster roll taken along line 13—13 in FIG. 11, with cross hatching omitted for clarity.

The radial passages 30 and cooling passages 34 are preferably arranged to provide a plurality of counter-flowing cooling water circuits in the first metal overlay 14 (or roll body 18). Referring, in particular, to FIGS. 11–13, the radial passages 30 are preferably defined substantially at each of the ends 38, 40 of the roll body 18 (i.e., proximate to the ends 38, 40 of the roll body 18). Thus, a plurality of the radial passages 30 (i.e., supply radial passages 30) are in fluid communication with the inlet passage 26*a* at, for example, the first end 38 of the roll body 18, and an additional plurality of the radial passages 30 (i.e., supply radial passages 30) are in fluid communication with the inlet passage 26*a* at the second end 40 of the roll body 18. As shown in FIGS. 12 and 13, cooling water will flow outward to the first metal overlay 14 substantially at both ends 38, 40 of the roll body 18. A similar configuration to the foregoing exists for the second inlet passage 26*b*.

Figure 15:
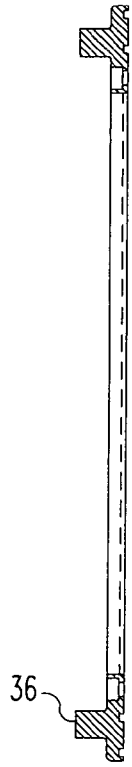
FIG. 15 is a cross sectional view of the end cap taken along line 15—15 in FIG. 14.

As described previously, the cooling passages 34 are preferably arranged in pairs, with each pair including an "inlet" cooling passage 34 and an interconnected "outlet" cooling passage 34 that returns heated water to one of the radial passages 30 for removal from the caster roll 10. Thus, the supply radial passages 30 at the first end 38 of the roll body 18 supply cooling water to respective inlet cooling passages 34 that carry cooling water from the first end 38 to the second end 40 of the roll body 18 of the roll core 12. Heated water is returned to the starting point (first end 38) through the respectively interconnected outlet cooling passages 34. Similarly, the supply radial passages 30 at the second end 40 of the roll body 18 supply cooling water to respective inlet cooling passages 34 that carry cooling water from the second end 40 of the roll body 18 to the first end 38 (i.e., in the opposite direction). Again, heated water is returned the length of the first metal overlay 14 (or roll body 18) through the respectively interconnected outlet cooling passages 34. Heated water is conducted away from the first metal overlay 14 through the return radial passages 30 provided at both ends 38, 40 of the roll body 18. The return radial passages 30 are in fluid communication with the outlet passages 28*a*, 28*b*, which conduct the heated water from the caster roll 10. As will be appreciated by those skilled in the art, the first metal overlay 14 and second metal overlay 16 formed thereon are cooled by counter-flowing cooling water flows, which flow the length of the first metal overlay 14 (or roll body 18). FIGS. 14 and 15 show the annular end cap 36 that seals or closes the open ends of the cooling passages 34, whether provided in the first metal overlay 14 or roll body 18. The end caps 36 may also be used to seal the ends of the "angled" radial passages 30, as indicated previously.

The casting roll 10 and procedures for making the same described hereinabove result in a caster roll having reduced maintenance and repair costs. Additionally, the deposition of the first and second metal overlays 14, 16, for example by submerged arc welding, on the roll core 12 eliminates the roll shell/roll core slippage problem that is well known in the art. Further, the use of multiple metal overlays on the roll core 12 reduces the possibility of cooling water leaking onto the external surface of the caster roll 10 (i.e., surface 50), which improves the safety of the caster roll 10 when in use. It is believed that the roll shell replacement costs associated with prior art caster rolls may be reduced significantly using the processes described hereinabove and that the eccentricity problem associated with prior art caster roll may be reduced by up to about half (i.e., 50%).

While preferred embodiments of the present invention were described hereinabove, obvious modifications and alterations of the present invention may be made without departing from the spirit and scope of the present invention. The scope of the present invention is defined in the appended claims and equivalents thereto.

What is claimed is:

1. A method of manufacturing a roll adapted for use in manufacturing metal plate, strip sheet, or foil, comprising the steps of:

providing a cylindrical roll core having a central longitudinal axis;

forming a metal overlay on the roll core; and forming a plurality of longitudinally extending inlet cooling passages and a plurality of outlet cooling passages in the metal overlay for conducting a cooling medium through the metal overlay to cool the roll during use.

2. The method of claim 1 wherein the metal overlay is formed on the roll core by a process selected from the group consisting of: submerged arc welding, spray forming, thermal spraying, hot isostatic pressing, pack diffusion, vapor deposition, arid electrolytic pressing.

3. The method of claim 1 wherein the cooling passages are formed in the metal overlay to be spaced regularly about the central longitudinal axis of the roll core.

4. The method of claim 1 wherein the step of forming the longitudinally extending cooling passages comprises drilling holes in the metal overlay extending substantially parallel to the central longitudinal axis of the roll core.

5. The method of claim 1 wherein the roll core comprises a roll body, the step of forming the longitudinally extending cooling passages comprises drilling holes in the metal overlay extending substantially parallel to the central longitudinal axis of the roll core and the entire length of the roll body.

6. The method of claim 5 further comprising the step of attaching end caps to opposite ends of the roll body to close the ends of the cooling passages.

7. The method of claim 1 further comprising the step of heat treating the roll to a temperature of between about 400° F. to 1500° F. for between about 1 to 48 hours after forming the metal overlay on the roll core.

8. The method of claim 1 wherein the roll core defines at least one centrally located and longitudinally extending inlet passage, the method further comprising forming a plurality of radially extending passages in the metal overlay and roll core to connect the cooling passages to the at least one inlet passage.

9. The method of claim 8 further comprising the step of plugging the radial passages at the surface of the metal overlay.

10. The method of claim 8 wherein the step of forming the radially extending cooling passages in the roll core comprises drilling holes in the metal overlay and roll core extending substantially perpendicular to the central longitudinal axis of the roll core to connect the cooling passages to the at least one inlet passage.

11. The method of claim 8 wherein the step of forming the radially extending cooling passages in the roll core comprises drilling holes in the metal overlay and roll core at an acute angle with respect to the central longitudinal axis of the roll core to connect the cooling passages to the at least one inlet passage.

12. The method of claim 1 wherein the roll core defines at least one centrally located and longitudinally extending inlet passage and at least one centrally located and longitudinally extending outlet passage, the method further comprising forming a plurality of radially extending passages in the metal overlay and roll core to connect the cooling passages to the ac least one inlet passage and the at least one outlet passage.

13. The method of claim 12 further comprising the step of plugging the radial passages at the surface of the metal overlay.

14. The method of claim 12 wherein the step of forming the radially extending cooling passages in the roll core comprises drilling holes in the metal overlay and roll core extending substantially perpendicular to the central longitudinal axis of the roll core to connect the cooling passages to the at least one inlet passage and at least one outlet passage.

15. The method of claim 12 wherein the step of forming the radially extending cooling passages in the roll core comprises drilling holes in the metal overlay and roll core at an acute angle with respect to the central longitudinal axis of the roll core to connect the cooling passages to the at least one inlet passage and at least one outlet passage.

16. A method of manufacturing a roll adapted for use in manufacturing metal plate, strip, sheet, or foil, comprising the steps of:

providing a cylindrical roll core having a central longitudinal axis;

forming a first metal overlay on the roll core;

forming a plurality of longitudinally extending inlet cooling passages and a plurality of outlet cooling passages in the first metal overlay for conducting a cooling medium through the metal overlay to cool the roll during use; and forming at least one additional metal overlay on the first metal overlay.

17. The method of claim 16 wherein the first metal overlay and the at least one additional metal overlay are formed on the roll core by a process selected from the group consisting of: submerged arc welding, spray forming, thermal spraying, hot isostatic pressing, pack diffusion, vapor deposition, and electrolytic plating.

18. The method of claim 16 wherein the cooling passages are formed in the first metal overlay to be spaced regularly about the central longitudinal axis of the roll core.

19. The method of claim 16 wherein the step of forming the longitudinally extending cooling passages comprises drilling holes in the first metal overlay extending substantially parallel to the central longitudinal axis of the roll core.

20. The method of claim 16 wherein the roll core comprises a roll body, the step of forming the longitudinally extending cooling passages comprises drilling holes in the first metal overlay extending substantially parallel to the central longitudinal axis of the roll core and the entire length of the roll body.

21. The method of claim 16 further comprising the step of attaching end caps to opposite ends of the roll body to close the ends of the cooling passages.

22. The method of claim 16 further comprising the step of heat treating the roll to a temperature of between about 400° F. to 1500° F. for between about 1 to 48 hours after forming the at least one additional metal overlay on the first metal overlay.

23. The method of claim 16 wherein the roll core defines at least one centrally located and longitudinally extending inlet passage, the method further comprising forming a plurality of radially extending passages in the first metal overlay and roll core to connect the cooling passages to the at least one inlet passage.

24. The method of claim 23 further comprising the step of plugging the radial passages at the surface of the first metal overlay prior to the step of forming the at least one additional metal overlay on the first metal overlay.

25. The method of claim 23 wherein the step of forming the radially extending cooling passages in the roll core comprises drilling holes in the first metal overlay and roll core extending substantially perpendicular to the central longitudinal axis of the roll core to connect the cooling passages to the at least one inlet passage.

26. The method of claim 23 wherein the step of forming the radially extending cooling passages in the roll core comprises drilling holes in the first metal overlay and roll core at an acute angle with respect to the central longitudinal axis of the roll core to connect the cooling passages to the at least one inlet passage.

27. The method of claim 16 wherein the roll core defines at least one centrally located and longitudinally extending inlet passage and at least one centrally located and longitudinally extending outlet passage, the method further comprising forming a plurality of radially extending passages in the first metal overlay and roll core to connect the cooling passages to the at least one inlet passage and the at least one outlet passage.

28. The method of claim 27 further comprising the step of plugging the radial passages at the surface of the first metal overlay prior to the step of forming the at least one additional metal overlay on the first metal overlay.

29. The method of claim 27 wherein the step of forming the radially extending cooling passages in the roll core comprises drilling holes in the first metal overlay and roll core extending substantially perpendicular to the central longitudinal axis of the roll core to connect the cooling passages to the at least one inlet passage and at least one outlet passage.

30. The method of claim 27 wherein the step of forming the radially extending cooling passages in the roll core comprises drilling holes in the first metal overlay and roll core at an acute angle with respect to the central longitudinal axis of the roll core to connect the cooling passages to the at least one inlet passage and at least one outlet passage.

* * * * *